US007887214B2

(12) United States Patent
Chang et al.

(10) Patent No.: US 7,887,214 B2
(45) Date of Patent: Feb. 15, 2011

(54) SOLAR LED LAMP

(75) Inventors: Chien-Lung Chang, Taipei County (TW); Chien-Lung Wei, Taipei County (TW)

(73) Assignee: Sunny General International Co., Ltd., Taipei County (TW)

( * ) Notice: Subject to any disclaimer, the term of this patent is extended or adjusted under 35 U.S.C. 154(b) by 163 days.

(21) Appl. No.: 12/358,107

(22) Filed: Jan. 22, 2009

(65) Prior Publication Data

US 2010/0182775 A1 Jul. 22, 2010

(51) Int. Cl.
*F21L 4/00* (2006.01)

(52) U.S. Cl. ..... 362/183; 362/157

(58) Field of Classification Search ..... 362/157, 362/183

See application file for complete search history.

(56) References Cited

U.S. PATENT DOCUMENTS 5,065,291 A * 11/1991 Frost et al. ..... 362/183
5,782,552 A * 7/1998 Green et al. ..... 362/183
6,054,208 A * 4/2000 Rega et al. ..... 428/323
2003/0079387 A1* 5/2003 Derose ..... 40/544
2005/0024868 A1* 2/2005 Nagai et al. ..... 362/227
2005/0174762 A1* 8/2005 Fogerlie ..... 362/183
2007/0263381 A1* 11/2007 Goldman et al. ..... 362/183
2010/0170115 A1* 7/2010 Smith, III ..... 36/137

* cited by examiner

*Primary Examiner*—Stephen F. Husar
*Assistant Examiner*—Peggy A. Neils
(74) *Attorney, Agent, or Firm*—WPAT, P.C.; Anthony King

(57) ABSTRACT

The present invention provides a solar LED (Light Emitting Diode) lamp, comprising a control circuit; a solar panel electrically connected to the control circuit; a rechargeable battery electrically connected to the control circuit; at least one light emitting diode (LED) electrically connected to the control circuit; and a transparent body which is one-piece molded with all of the above electronic elements encased therein. The solar LED lamp according to the present invention can allow the electronic elements therein to be totally segregated from external environment by encasing all of the electronic elements in a one-piece molded transparent body; thereby, the solar LED lamp can be used durably.

7 Claims, 4 Drawing Sheets

SOLAR LED LAMP

FIELD OF THE INVENTION

The present invention is related to a solar LED lamp, especially those having all electronic elements encased in an one-piece molded transparent body.

BACKGROUND OF THE INVENTION

As fossil fuels are exhausting, various alternative energy sources, for example, hydroelectric power, wind electric power, geothermal electric power or solar electric power, are actively developed all over the world. Among these alternative energy sources, solar electric power are widely used, for example, in public constructions, including traffic signs such as speed limit signs, slogan signs or road margin signs, wherein the road margin signs usually comprises plural underground lights disposed at intervals. In the earlier times, in order to make drivers easier to see non-illuminating road margin signs, plural Cat's Eye Stones, which can reflex light, were disposed at intervals along the road margin. However, Cat's Eye Stones reflex light when irradiated by light, but they themselves do not emit light; therefore, in case that drivers do not turn on head lights or in case that drivers drive through a foggy area, the drivers may be still exposed to danger due to poor light reflex of Cat's Eye Stones.

In order to overcome the disadvantages of Cat's Eye Stones, some self-illuminating underground lights were developed. Such underground light usually comprises a solar panel, a circuit board, a rechargeable battery and a light-emitting diode, which are all encased in a transparent body. The conventional transparent body consists of at least two semi-housings. On assembling, all electronic elements are first placed into one semi-housing, then covered with the other semi-housing and sealed. However, when subjected to sun shining and rain leaching in external environment for long period, the sealing of the conventional transparent body may be damaged, and moisture and contaminants from environment may penetrate through the sealing and enter into the transparent body, which may lead to damage of the electronic elements encased therein and shortening of the life span of the underground light. In addition, the conventional transparent body is usually made of glass, or injection-molded polycarbonate (PC), which may deteriorate or become yellow or brittle if subjected to sun shining and rain leaching in external environment for long period; as a result, the electronic elements encased therein may be exposed to the danger of being damaged by external environment and the life span of the underground light may be shortened.

Therefore, it is desired to development a self-illuminating lamp, which can segregate the electronic elements from external environment and is durable in use.

SUMMARY OF INVENTION

In view of the disadvantages of conventional lamps as stated above, the inventor made an intensive study in this field and tried to overcome these advantages. As a result, it is found that a solar LED lamp as stated below can allow the electronic elements therein to be totally segregated from external environment and can be used durably. The present invention thus has been completed.

The main object of the present invention is to provide a solar LED lamp which can allow electronic elements thereof to be totally segregated from external environment by encasing all of the electronic elements with a transparent body in a manner of one-piece molding, and hence is durable in use.

To achieve the above object, the solar LED lamp according to the present invention comprises: a control circuit; a solar panel electronicly connected to the control circuit; a rechargeable battery electronicly connected to the control circuit; at least one light emitting diode (LED) electronicly connected to the control circuit; and a transparent body which is one-piece molded with all of the above electronic elements encased therein.

According to the present invention, the transparent body is made of a material selected from polyurethanes, epoxy resins, unsaturated resins or acrylic resins. The polyurethane is formed by mixing a main agent with a curing agent. The main agent comprises a diol or triol with a molecular weight ≦300, a polyether triol with a molecular weight of 300 to 8000 and a diisocyanate. The curing agent comprises a polyether triol with a molecular weight of 300 to 8000 and an aliphatic or alicyclic diisocyanate. The main agent has a viscosity <1500 cps and the curing agent has a viscosity <1000 cps. The main agent is mixed with the curing agent in a ratio between 1:3 to 3:1, to form a mixture. The mixture of the main agent and the curing agent are defoamed in vacuum. Thereafter, all of the electronic elements are encased in a transparent body, which is formed by one-piece molding from the defoamed mixture, baking at a temperature of 40° C. to 80° C. for 30 to 120 minutes, then cooling. After the cooling step, the product is aged at a temperature of 40° C. to 80° C. for 30 to 60 minutes. The reaction between the main agent and the curing agent after their mixing is controlled by a catalyst and an inhibitor.

The solar LED lamp according to the present invention can allow the electronic elements therein to be totally segregated from external environment and hence can be used durably.

DETAILED DESCRIPTION OF THE PREFERRED EMBODIMENT

For full understanding of the objects, the features and the effects of the present invention, the present invention is illustrated by the following embodiments in reference to the attached drawings.

Figure 1:
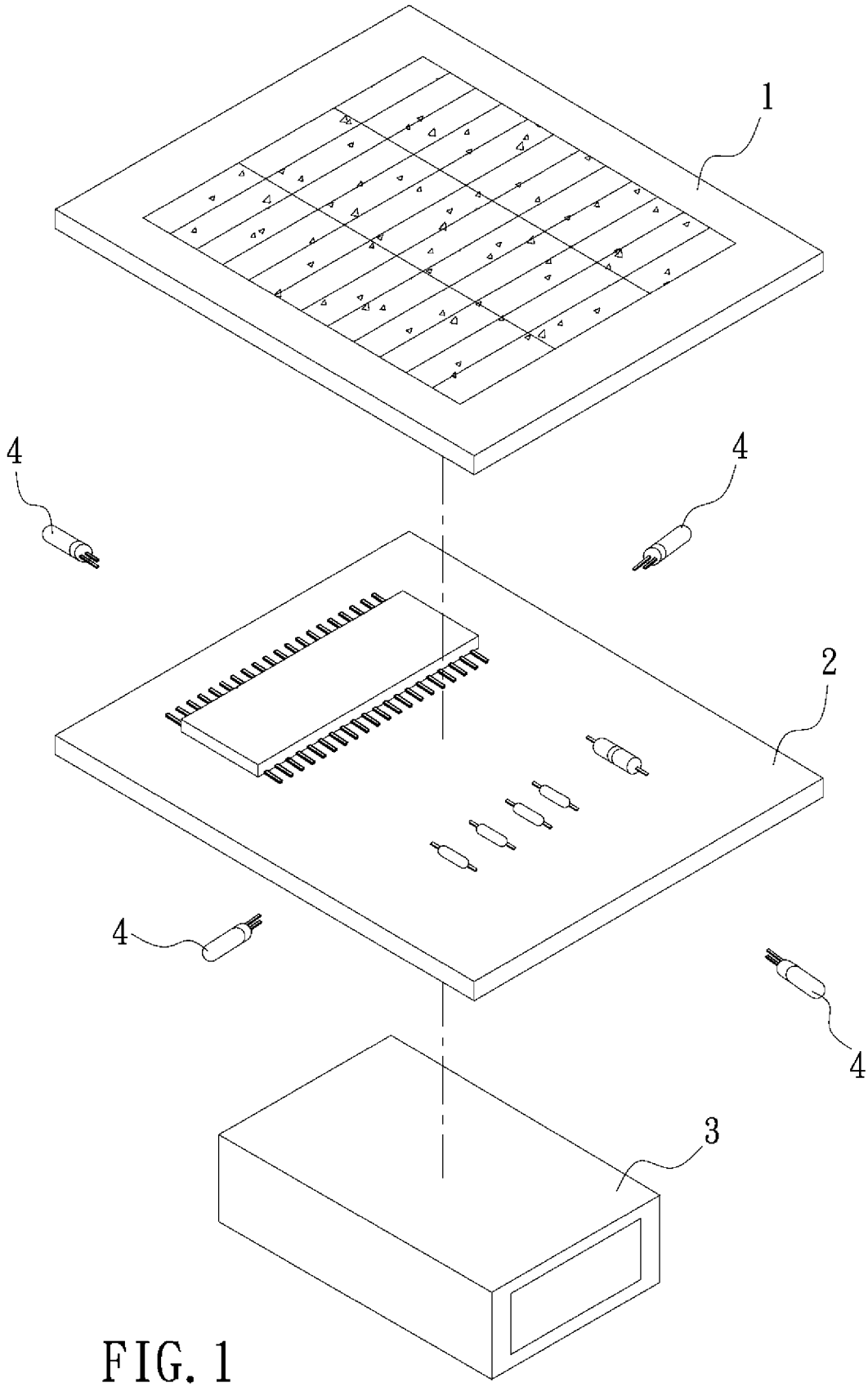
FIG. 1 shows the exploded view of the electronic elements according to the preferred embodiment of the present invention.
Figure 2:
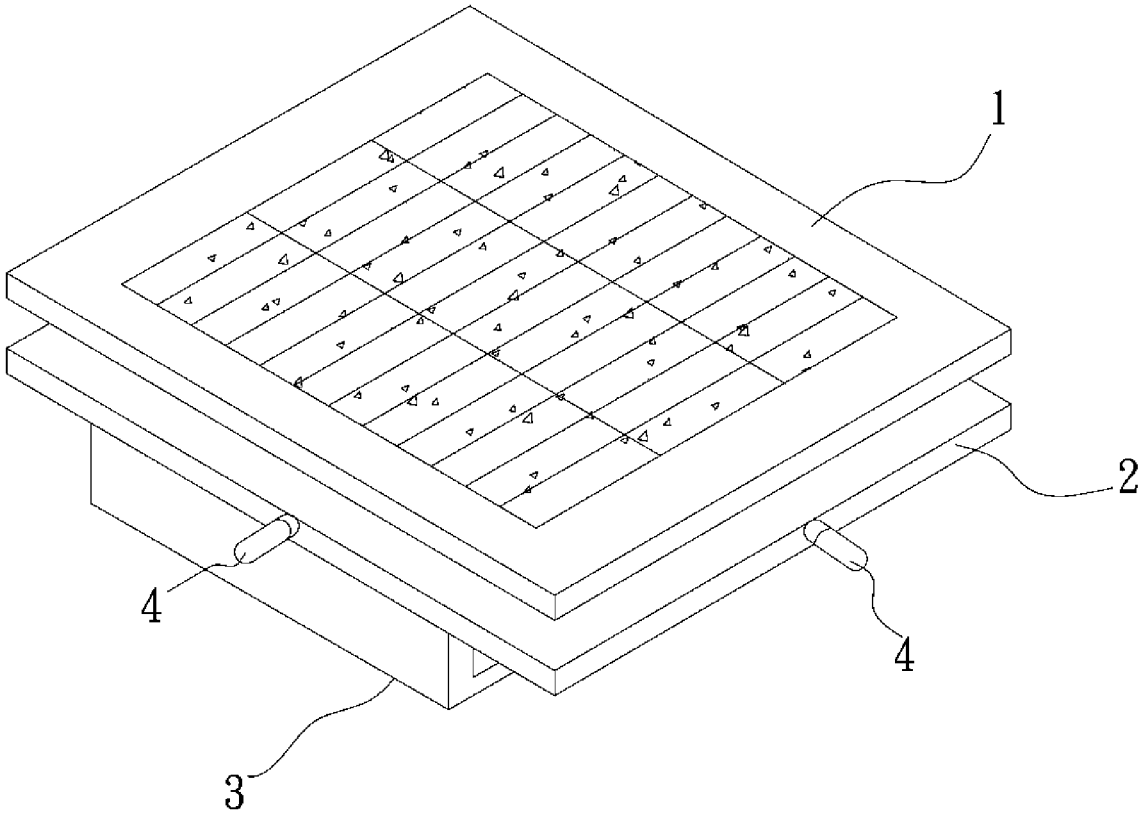
FIG. 2 shows the assembled view of the electronic elements according to the preferred embodiment of the present invention.
Figure 3:
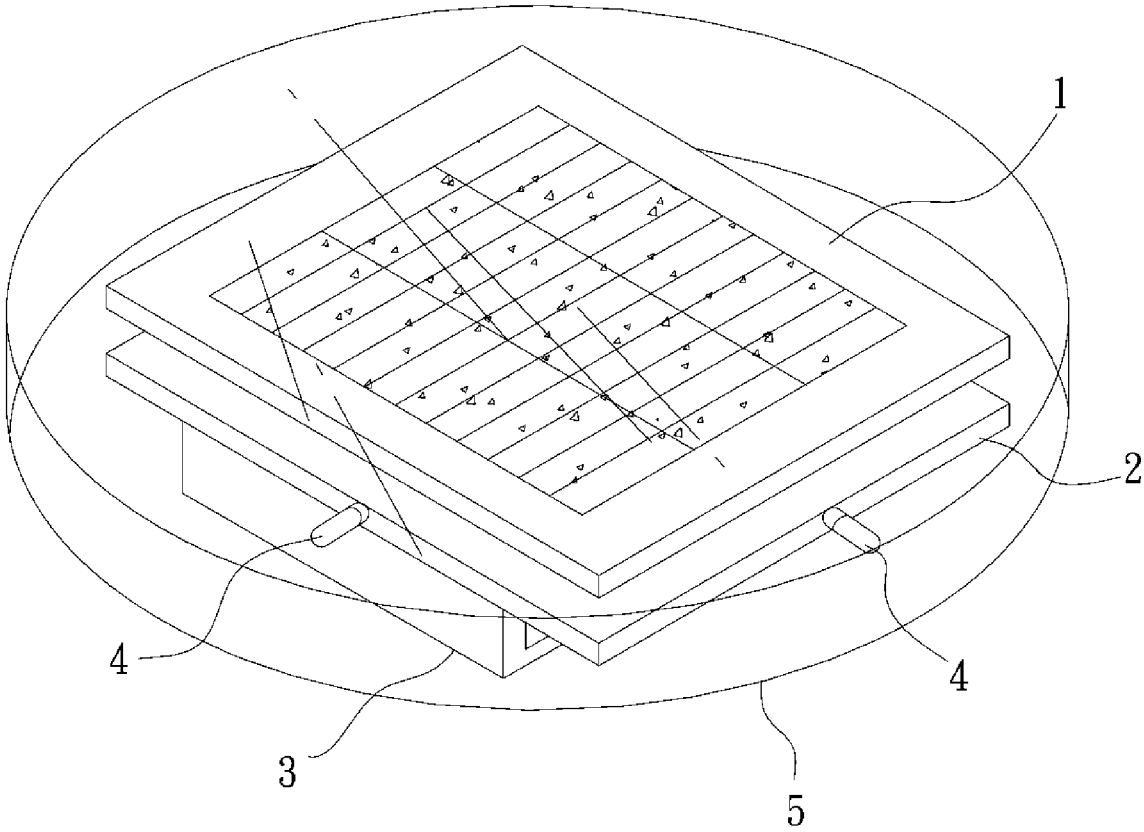
FIG. 3 shows the three dimensional view of one preferred embodiment of the present invention.

FIGS. 1 to 3 are respectively the exploded view, the assembled view and the three dimensional view of the preferred embodiment of the electronic elements according to the present invention. As shown in these figures, the solar LED lamp according to the present invention comprises a control circuit 2, a solar panel 1, a rechargeable battery 3, at least one LED 4 and a transparent body 5; wherein the solar panel 1, the rechargeable battery 3 and the LED 4 are all electrically connected to the control circuit 2 and the transparent body 5 are one-piece molded with all of the above electronic elements encased therein.

In the present invention, the solar panel 1 may be a monocrystalline solar panel, polycrystalline solar panel or thin-film solar panel. The LED 4 is preferably low-energy-consuming and its brightness, type and amount may be varied if needed. The rechargeable battery 3 is used for storage of electronic energy and the control circuit 2 is used for controlling the conditions (such as flicker frequency, charging-discharging, voltage and current etc.) of the solar panel 1, the LED 4 and the rechargeable battery 3. The transparent body 5 may be made of a material selected from polyurethanes (which are non-yellowing, environment-friendly and suitable for use in micro injection molding), epoxy resins, unsaturated resins, acrylic resins etc. The polyurethane is formed by mixing a main agent with a curing agent. The main agent comprises a diol or triol with a molecular weight ≦300, a polyether triol with a molecular weight of 300 to 8000 and a diisocyanate; and the curing agent comprises a polyether triol with a molecular weight of 300 to 8000 and an aliphatic or alicyclic diisocyanate. From the viewpoint of easy manual operation, the main agent preferably has a viscosity <1500 cps and the curing agent preferably has a viscosity <1000 cps. The main agent is mixed with the curing agent in a ratio between 1:3 and 3:1 to form a mixture, wherein the ratio of NCO to OH is between 1:1.1 and 1.1:1. The pot life for the mixture of the main agent and the curing agent should be longer than 30 minutes such that there is enough time to perform subsequent operations. In order to avoid formation of blisters in the product, the mixture of the main agent and the curing agent is preferably defoamed in vacuum for 1 to 3 minutes. Thereafter, all of the above electronic elements are encased in a transparent body 5 which is formed by one-piece molding from the defoamed mixture, then baking at a temperature of 40° C. to 80° C. for 30 to 120 minutes (for example, 30 minutes), and then cooling. After cooling, the product is aged at a temperature of 40° C. to 80° C. for 30 to 60 minutes to stabilize the physical properties of the product. The reaction between the main agent and the curing agent after their mixing is controlled by a catalyst and an inhibitor.

In one embodiment for producing the solar LED lamp according to the present invention, the main agent is a colorless, transparent liquid with a viscosity between 500 cps and 800 cps; a curing agent is a colorless, transparent liquid with a viscosity between 300 cps and 500 cps; the main agent is mixed with a curing agent in a ratio of 1:1 to form a transparent liquid with a viscosity between 500 cps and 600 cps. The main agent is mixed with the curing agent for 1 minute and the mixture is defoamed in vacuum for 2 minutes. The defoamed mixture has a pot time of 20 minutes at 25° C. The mold has a temperature of 80° C., and its releasable time after casting is about 30 minutes. After released from the mold, the product is aged at 80° C. for 30 minutes. The product obtained from the above procedures is a white, transparent product with a hardness between 70 D and 80 D, and a gray scale of rank 4 or higher after ultraviolet irradiation for 3 hours.

Figure 4:
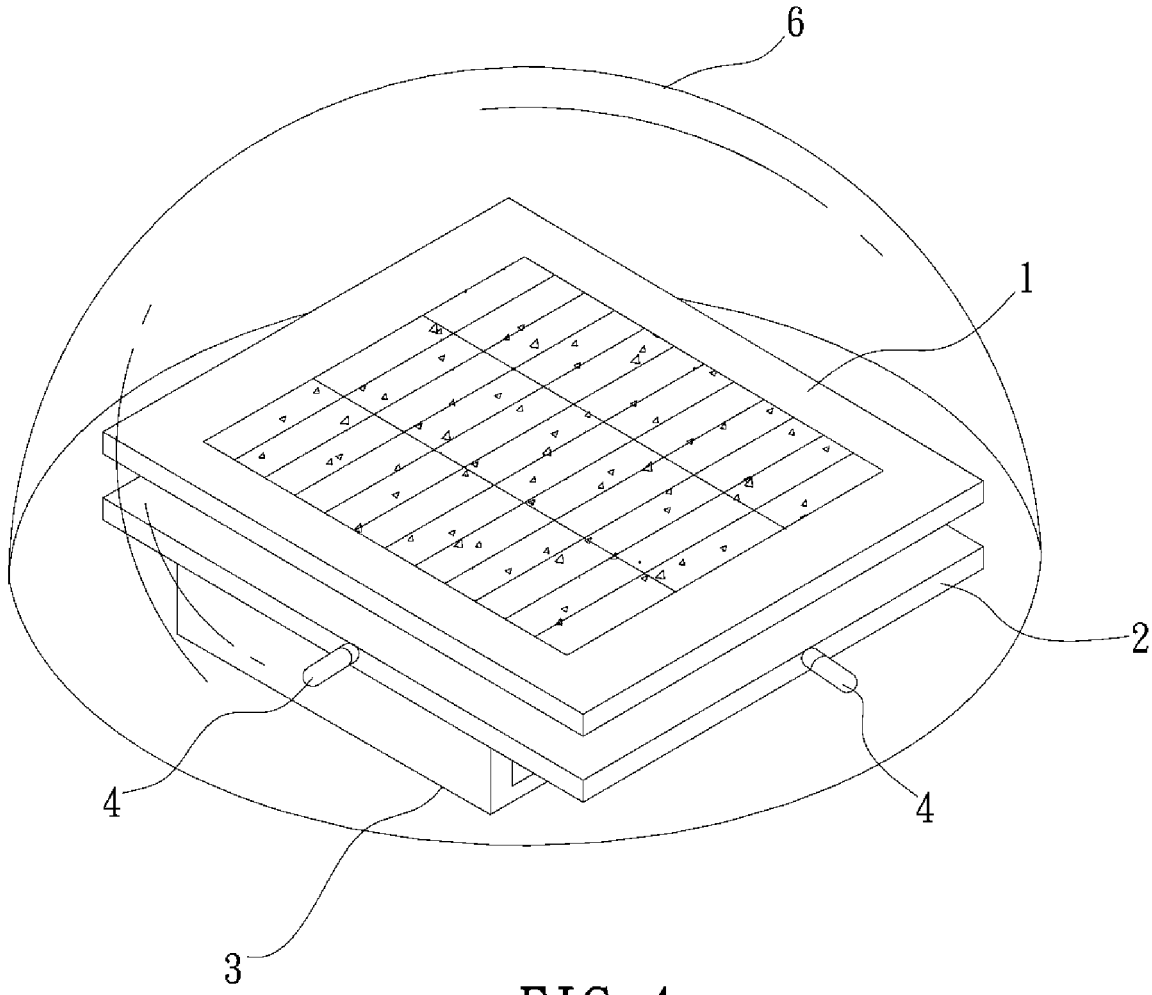
FIG. 4 shows the three dimensional view of another preferred embodiment of the present invention.

In summary, the solar LED lamp according to this invention uses environment-friendly, non-yellowing, two-liquid type polyurethanes having high transparency, high weather resistance, high moisture resistance, as material for constituting the transparent body 5. Due to high transparency of polyurethanes, the solar panel 1 has high solar energy absorption and hence the solar LED lamp can maintain high brightness. Due to high weather resistance of polyurethanes, the solar LED lamp can be used outdoors for long period without yellowing and decomposition. Due to high moisture resistance of polyurethanes, the electronic elements encased in the transparent body 5 can be protected from corrosion and damage caused by water and moisture, and hence the solar LED lamp can be used in as illuminator or warning sign at waterside or at the side of swimming pools. In addition, polyurethanes are moldable at lower temperature and highly insulating, which makes it possible to protect the electronic parts and the circuit or the battery from damage during the manufacturing process, such that the solar LED lamp can be produced without adversely affecting the operation of the circuit therein. Thereby, the produced solar LED lamp has optimized performance. Furthermore, using polyurethane as the material for constituting the transparent body 5 makes the produced solar LED lamp become environment friendly and manually operable as well as having a crystal-like appearance and a variable shape. FIG. 4 shows the three dimensional view of another preferred embodiment of this invention. As shown in FIG. 4, the transparent body 6 according to the present invention can have a hemispheric shape or other shape, in addition to a cylindrical shape as shown in FIG. 3.

As stated above, the present invention complies with the following three requirements for a patentable invention: novelty, inventiveness and industrial utilization value. The novelty and inventiveness of the present invention exist in that all of the electronic elements are encased in a transparent body, which is formed by one-piece molding, such that the electronic elements can be totally segregated from external environment and hence the solar LED lamp is durable in use. In addition, the solar LED lamp according to this invention can fully meet the demands of the market and hence has industrial utilization value.

The present invention has been disclosed by the above preferred embodiments; however, the persons skilled in the art understand that these embodiments are intended to illustrate this invention, not limit this invention thereto. It should be noted that any equivalent alterations or substitutions of these embodiments are considered to fall in the scope of this invention. The protection scope of the present invention is defined by the claims attached here-in-below.

What is claimed is:

1. A solar LED (Light Emitting Diode) lamp, comprising:
- a control circuit;
- a solar panel electrically connected to the control circuit;
- a rechargeable battery electrically connected to the control circuit;
- at least one light emitting diode (LED) electrically connected to the control circuit;
- a transparent body which is one-piece molded with all of the above electronic elements encased therein;
- wherein the transparent body is made of polyurethane, the polyurethane is formed by mixing a main agent with a curing agent;
- wherein the main agent comprises a diol or triol with a molecular weight ≦300, a polyether triol with a molecular weight of 300 to 8000 and a diisocyanate; and
- wherein the curing agent comprises a polyether triol with a molecular weight of 300 to 8000 and an aliphatic or alicyclic diisocyanate.

2. The solar LED lamp according to claim 1, wherein the main agent has a viscosity <1500 cps and the curing agent has a viscosity <1000 cps.

3. The solar LED lamp according to claim 2, wherein the main agent is mixed with the curing agent in a ratio between 1:3 and 3:1 to form a mixture, wherein the ratio of NCO to OH is between 1:1.1 and 1.1:1.

4. The solar LED lamp according to claim 3, wherein the mixture of the main agent and the curing agent is defoamed in vacuum.

5. The solar LED lamp according to claim 4, wherein all of the electronic elements are encased in a transparent body, which is formed by one-piece molding from the defoamed mixture, then baking at a temperature of 40° C. to 80° C. for 30 to 120 minutes, and then cooling.

6. The solar LED lamp according to claim 5, wherein after cooling, the product is aged at a temperature of 40° C. to 80° C. for 30 to 60 minutes.

7. The solar LED lamp according to claim 6, wherein the reaction between the main agent and the curing agent after their mixing is controlled by a catalyst and an inhibitor.

* * * * *